US006056709A

United States Patent [19]

Hashimoto

[11] Patent Number: 6,056,709

[45] Date of Patent: May 2, 2000

[54] PORTABLE MASSAGE DEVICE

[75] Inventor: Kouji Hashimoto, Osaka, Japan

[73] Assignee: Kabushiki Kaisha Protec Fuji, Osaka, Japan

[21] Appl. No.: 09/044,472

[22] Filed: Mar. 19, 1998

[30] Foreign Application Priority Data

Jan. 30, 1999 [JP] Japan ..... 10-033799

[51] Int. Cl.[7] ..... A61A 15/00

[52] U.S. Cl. ..... 601/127; 601/118; 601/127; 601/133; 601/134; D24/212; D24/215

[58] Field of Search ..... 601/26, 27, 32, 601/115, 118, 116, 119, 94, 122, 124, 126, 127, 125, 128, 129, 133, 134, 136; D24/212, 215

[56] References Cited

U.S. PATENT DOCUMENTS

| | | | |
|---|---|---|---|
| D. 305,563 | 1/1990 | Yamasaki . | |
| D. 349,772 | 8/1994 | Yamasaki et al. . | |
| 2,052,656 | 9/1936 | Prien . | |
| 2,306,424 | 12/1942 | Betz . | |
| 2,446,099 | 7/1948 | Niblack . | |
| 2,633,123 | 3/1953 | Bell . | |
| 3,279,462 | 10/1966 | Niquet | 601/118 |
| 3,398,741 | 8/1968 | Burk . | |
| 4,016,872 | 4/1977 | Yamamura et al. . | |
| 4,127,116 | 11/1978 | Pannetier . | |
| 4,505,267 | 3/1985 | Inada . | |
| 4,716,891 | 1/1988 | Yorgan . | |
| 4,782,823 | 11/1988 | Yamasaki . | |
| 5,460,598 | 10/1995 | Yamasaki et al. | 601/99 |
| 5,741,218 | 4/1998 | Fujii | 601/90 |
| 5,843,006 | 12/1998 | Phillips et al. | 601/133 |

FOREIGN PATENT DOCUMENTS

| | | | |
|---|---|---|---|
| 4-102454 | 4/1992 | Japan . | |
| 531088 | 12/1940 | United Kingdom | 128/33 |

OTHER PUBLICATIONS

Drawings from U.S. Serial No. 09/079 577, Filed May 15, 1998 Attorney Ref: Protec Fuji Case 53 (5 sheets).

*Primary Examiner*—Richard J. Apley
*Assistant Examiner*—Tam Nguyen
*Attorney, Agent, or Firm*—Flynn, Thiel, Boutell & Tanis, P.C.

[57] ABSTRACT

A portable massage device for providing effects of finger pressing massage and kneading massage (like fingers of a person repeatedly gripping and separating from each other) by kneading members including a driving mechanism 2 which is disposed on one of a pair of fixed plates 11 of a frame 1, a driven rotary shaft 3 which is rotatably held on the frame and driven to rotate by the driving member 2, driven rotary plates 4 which are disposed on the center part of the driven rotary shaft 3 and driven to rotate by the driving member 2, cam parts 41 which have a convex and concave surface 42 formed on one end, kneading members 5 which are disposed on shaft 3 and slide freely thereon, and have cam receiving parts 51 to contact the cam parts 41 of the driven rotary plates 4 for moving the kneading members toward and away from each other on the shaft 3, and a power spring member 6 which is disposed on the two kneading members 6 to make the motions of the kneading members 5 repeat continuously.

15 Claims, 5 Drawing Sheets

PORTABLE MASSAGE DEVICE

BACKGROUND OF THE INVENTION

1. Field of the Invention

The present invention relates to a portable massage device, specially to a portable massage device which a person can select rolling massage or finger pressing and kneading massage, and can do said two kind of massage in the same kind.

2. Description of the Prior Art

Since olden times, many kinds of massage devices have been provided to massage the human body, in special, a portable massage device has been widely practiced for easy portable use, low cost and good massage effect.

For example, a portable massage apparatus, which has a rotatable rolling massage member to touch and rub human body, provides a rolling massage, and which has a pair of eccentric members oppositely in the center part to provide kneading massage to human body, can provide a good massage effect to stimulate blood circulation for relieving fatigue of a patient, so that it has been liked by the patients.

However, the above-identified portable massage apparatus can provide rolling massage, or monotonous kneading massage, but can't provide a gripping and kneading massage which has a finger pressing massage effect to a patient.

These problems relates to the construction of the portable massage device, which has a member that can repeat the gripping and separating motion like human fingers, including a more complex construction that the construction for providing kneading massage and the construction for providing rolling massage. The problems also relate to the cost and difficulty for development of the gripping and kneading mechanism which provides the complex motion incorporated into a low cost portable massage. Thus, this mechanism has not been developed.

Therefore, it is an object of the present invention to provide a portable massage device designed so as to bring the effects of finger pressing and kneading like a person by a gripping member for kneading to repeat gripping and separate motion in a twinkling intermitting motion.

And it is a further object of the present invention to provide a portable massage device designed so as to bring effects of finger pressing and kneading like a person by a kneading member for gripping to repeat the gripping and separating motion in a twinkling motion, and these massage effects can be provided to all range of using possibly on the body of the portable massage device at the same condition.

SUMMARY OF THE INVENTION

The portable massage device of present invention comprises:

a driving mechanism disposed on a pair of fixed plates of outside frame, and driven rotary shaft which is held said fixed plates of outside frame, and can be driven to rotate by said driving mechanism simultaneously, and driven rotary plates which are disposed on the center part of said driven rotary shaft oppositely, and can be driven to rotate by said driving mechanism, and has a cam part having a convex, then concave (undulating) surface formed on an end, and kneading members which are fixed, and have a cam receiving part to connect to the cam part of said driven rotary plates for providing motion of being close to and separating from each other oppositely, and can slide freely, and a spiral power spring which is disposed on said two kneading members, and can make the motion of being close to and separating from each other continuously.

Further, a portable massage device of the present invention comprises: said driving mechanism which has a driving motor disposed on said outside frame, and a gear wheel of driving shaft disposed on the shaft end of said driving motor, and a driving shaft engaged with said gear wheel of driving shaft for transfering a rotary force to the gear wheel of driven shaft and driven rotary plates disposed on said driven rotary shaft.

Furthermore, a portable massage device of the present invention comprises: a driving gear wheel which is engaged with said gear wheel of driving shaft and said gear wheel of driven shaft is connected with kneading drive gear wheel engaged with said driven rotary plates on the said driving shaft.

Further, a portable massage device of the present invention comprises: a protection mechanism disposed over the outside of the spiral power spring installed between said two kneading members.

Further, a portable massage device of the present invention comprises: said protection mechanism has a tube-shaped member with a bottom and a tube-shaped member without a bottom, and said tube-shaped member with a bottom has one end fixed on one kneading members and the other end connected to said spiral power spring, and slides along the driven rotary shaft, and said tube-shaped member without a bottom has one end fixed on the other kneading member, the other end can inlay with said tube-shaped member with a bottom, and slides along to the driven rotary shaft.

Further, a portable massage device of the present invention comprises: one or more of the guide rods is erected above a pair of fixed plates of said outside frame, and one or more of the guide holes are opened to receive said guide rods.

Further, a portable massage device of the present invention comprises: a convex and concave (undulating) surface which is made on the cam part of the said driven rotary plates and is formed to staged-shaped as seen from the side.

Further, a portable massage device of the present invention comprises: said convex and concave surface is formed to have a plurality of convex and concave portions.

DETAILED DESCRIPTION

Figure 1:
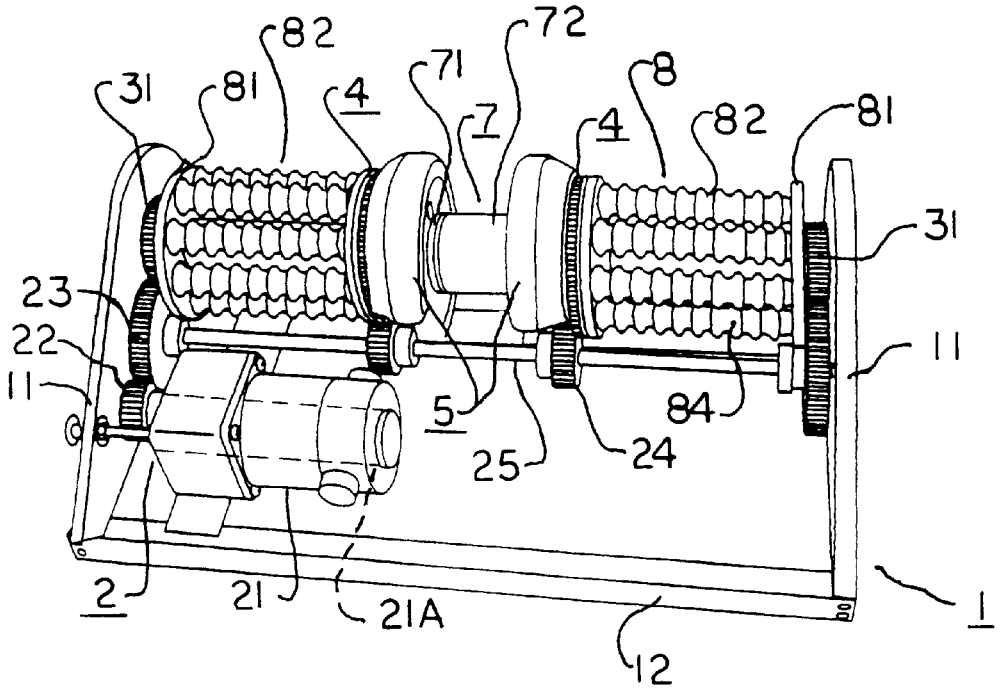
FIG. 1 is an oblique drawing shown an internal mechanism of portable massage device which is an embodiment of this invention.
Figure 2:
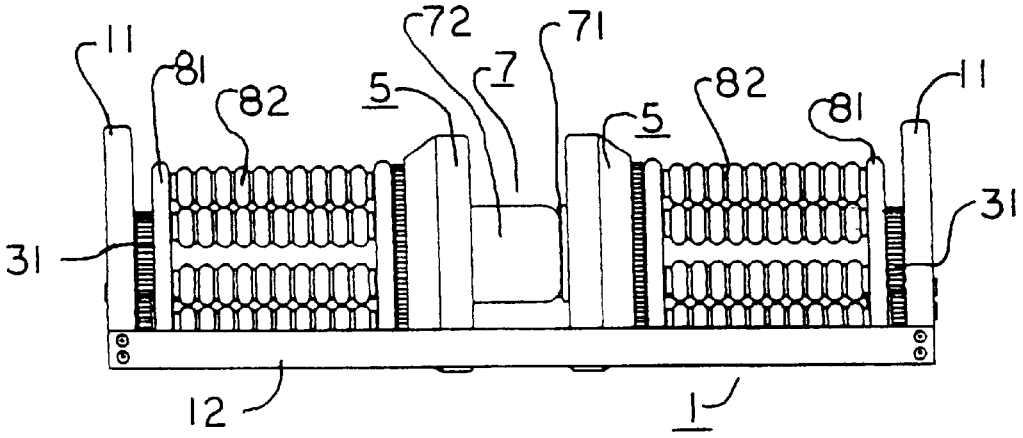
FIG. 2 is a front view showing the status which a pair of kneading members of the portable massage device of the present invention are close to each other.

The portable massage device of present invention comprises:

a driving mechanism 2 disposed on a pair of fixed plates 11.11 of the outside frame 1, and driven rotary shaft 3 which is rotatably held in openings in said fixed plates 11 of outside frame 1, and can be driven to rotate by said driving mechanism 2 simultaneously, and driven rotary plates 4 which are held at an axial position at the center part of said driven rotary shaft 3 by an inner portion of drum-shaped member 81 oppositely each other, and can be driven to rotate by said driving mechanism 2, and have a cam part 41 having a convex and concave, i.e. undulating, surface 42 formed on each end, and kneading members 5 which are radially fixed on the shaft 3, and have a cam receiving parts 51 to connect to the cam parts 41 of said driven rotary plates 4.4 for providing motion of being close to and separating from each other oppositely, and can axially slide freely in response to the cam surface, and a spiral power spring 6 is disposed on the other end of member 71 and inner portion of member 72 and is disposed on the center part of the left kneading member 5 so as to continuously repeat the motion of kneading members.

Figure 10:
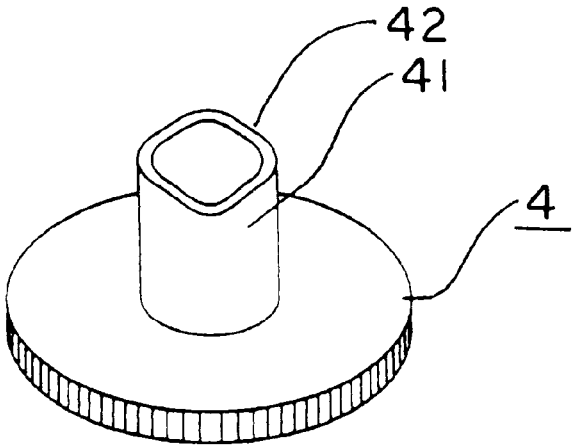
FIG. 10 is an oblique drawing showing driven rotary plates of portable massage device which is another embodiment of this invention.
Figure 11:
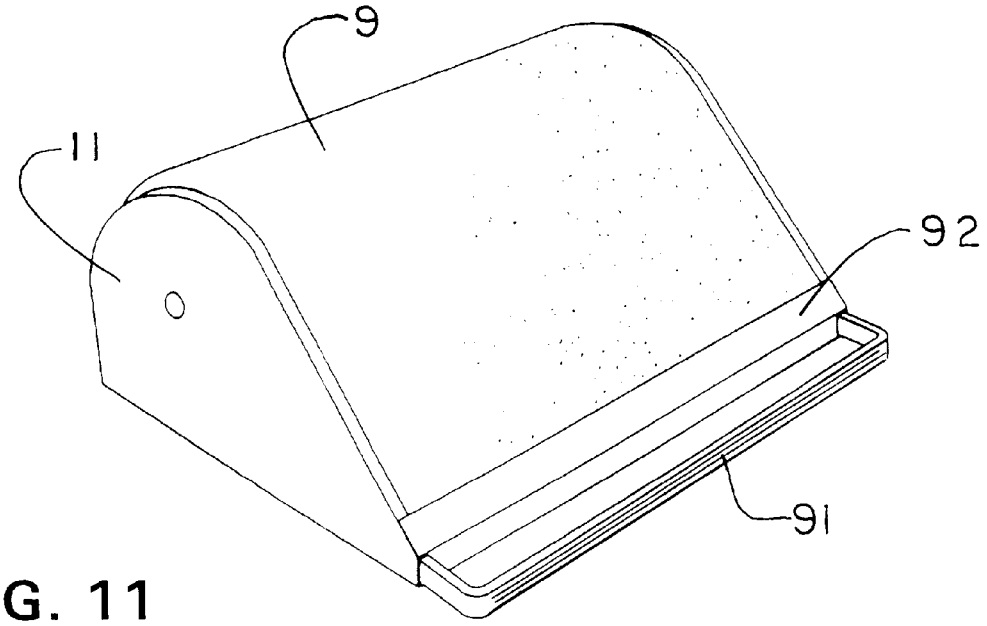
FIG. 11 is an oblique drawing showing a portable massage device which is an embodiment of this invention.

Said outside frame 1, as shown in the FIG. 1, FIG. 10 and FIG. 11, comprises a pair of fixed plates 11.11 and members 12.12 fixed on two fixed plates 11.11, the members 12 can be used for a handle rod.

Figure 3:
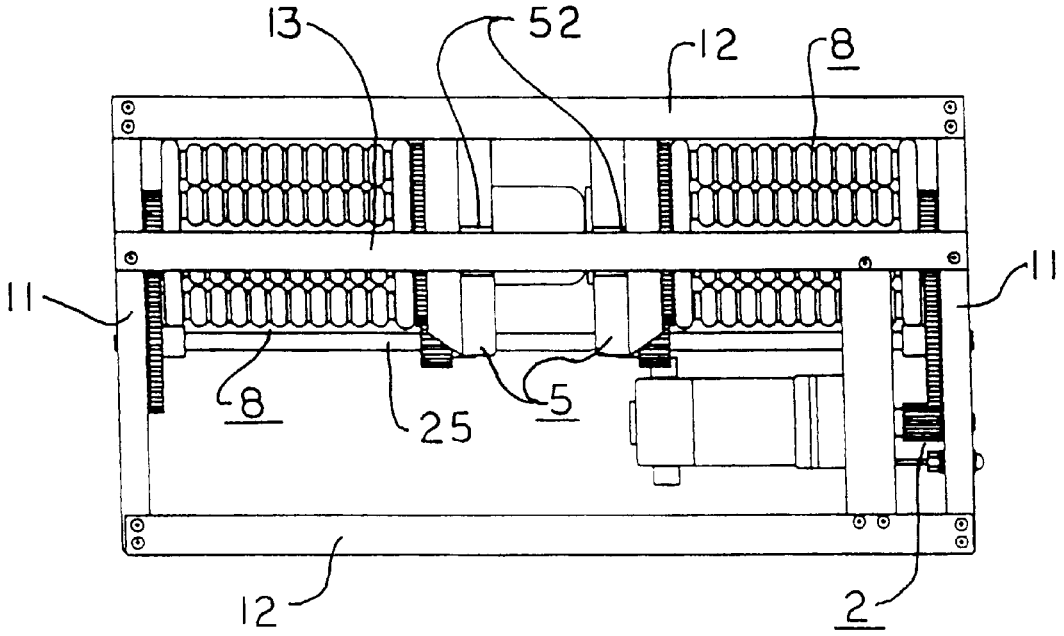
FIG. 3 is a bottom view showing an internal mechanism of portable massage device which is an embodiment of this invention.

One or more of guide rods 13 (one guide rod 13 is shown as an example shown on the drawing) are erected between a pair of fixed plates 11.11 of said outside frame 1 as shown in FIG. 3, said kneading members 5.5 can be overlay these guide rods 13, and slide along it to provide motion of being close to and separating from each other continuously. That is, the guide rod(s) 13 can inlay into a recess in the kneading members 5.

Said driving mechanism 2, as shown in FIG. 1, comprises a driving motor 21 disposed on a pair of fixed plates 11.11 of said outside frame 1, and a gear wheel 22 of driving shaft 21A disposed on the shaft end of said driving motor 21, and a driving shaft 25 engaged with said gear wheel 22 of the driving shaft 21A for transfering a rotary force to gear wheel 31 of driven shaft 3 and driven rotary plates 4 disposed on said driven rotary shaft 3, the driving shaft 25 can transfer the rotary force of the driving motor 21 to drive the rotary driven shaft 3 to make it rotate.

Driving gear wheel 23 engaged with said gear wheel 22 of driving shaft and said gear wheel 31 of driven shaft, is connected with kneading drive gear wheel 24 engaged with said driven rotary plates 4 on said driving shaft 25, the driving gear wheel 23 of the driving shaft 25 can transfer the rotary force of the driving motor 21 to said gear wheel 31 of driven shaft to make the driven rotary shaft 3 rotate, so that a pair of driven rotary plates 4.4 engaged with kneading drive gear wheels 24.24 can rotate independently by the rotary of kneading drive gear wheel 24.24 of driving shaft 25.

Said driven shaft 3 has an elongate tube-shape, and is held between a pair of fixed plates 11.11 by gear wheels 31.31 of driven shaft on its two ends, and can rotate by the rotary of the driving mechanism 2.

A pair of driven rotary plates 4.4 (driven rotary plate 4 is a driven rotary gear wheel as an example shown on the drawing) are disposed on the center part of said driven rotary shaft 3 oppositely facing each other at variable distances. The rotary plates 4 have a cam part 41 having a stage-shaped convex and concave surface 42 formed on each end, and can be driven to rotate independently by engaging with each kneading drive gear wheel 24.24 of said driving shaft 25.

Figure 8:
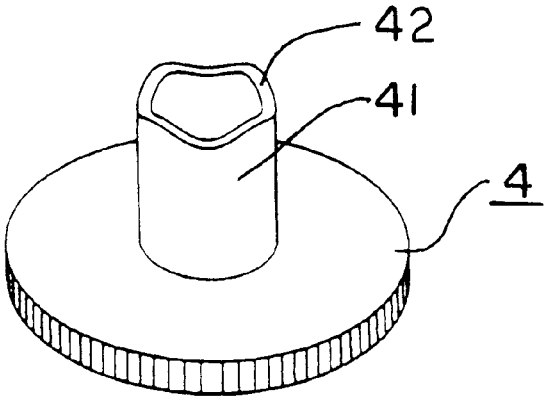
FIG. 8 is an oblique drawing showing driven rotary plates of portable massage device which is an embodiment of this invention.
Figure 9:
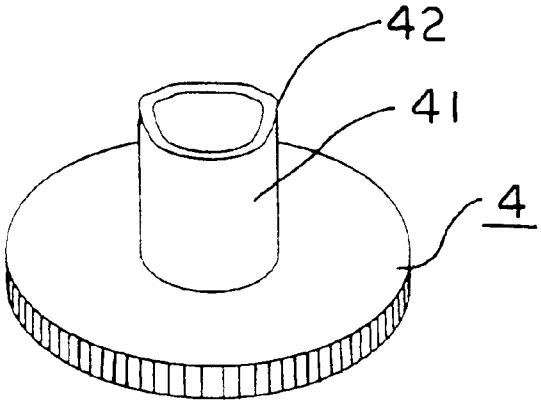
FIG. 9 is an oblique drawing showing driven rotary plates of portable massage device which is another embodiment of this invention.

The convex and concave surface 42 of the cam part 41 of said driven rotary plates 4 is formed with an undulating stage-shaped end and as a pedestal when seen from the side, but this convex and concave surface 42, as shown in FIG. 8 to FIG. 10, can be formed to wave-shaped or formed to have a plurality of convex and concave stages, so as to change the time of being close to and separating from each other, and times of being close to and separating from each other of said kneading members 5 to provide kneading finger pressure to a user.

Said kneading members 5, as shown in FIG. 1 and FIG. 4 to FIG. 7, are disposed on the center part of driven rotary shaft 3 oppositely, and can move close to and separate from each other continuously, and on which a cam receiving part 51 is disposed for receiving the cam part 41 of said driven rotary plates 4.4 in opposing sides, when the driving shaft 25 rotates the two kneading drive gear wheel 24.24 rotate, the cam part of 41 of said each driven rotary plates 4.4 also rotates, so that each cam receiving part 51 of said kneading members 5.5 will connect to each convex and concave surface 42 of said cam part 41 to make each kneading members 5.5 axially slide i.e. move close to and separate from each other, on said driven rotary shaft 3.

One more of guide holes 52 (one guide hole 52 is disposed according to one guide rod 13 as an example shown on the drawing) are opened in said each kneading members 5.5 to inlay with said guide rod 13, so that the kneading members 5.5 slide close to and separate from each other continuously along to said guide rod 13.

Figure 4:
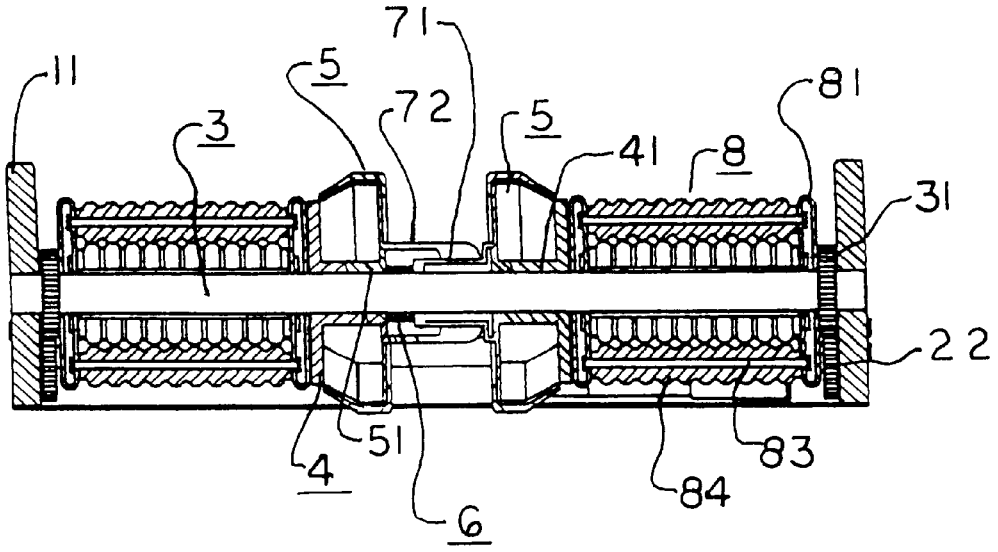
FIG. 4 is a central vertical sectional view showing the status which a pair of kneading members of the portable massage device of the present invention are close to each other.
Figure 5:
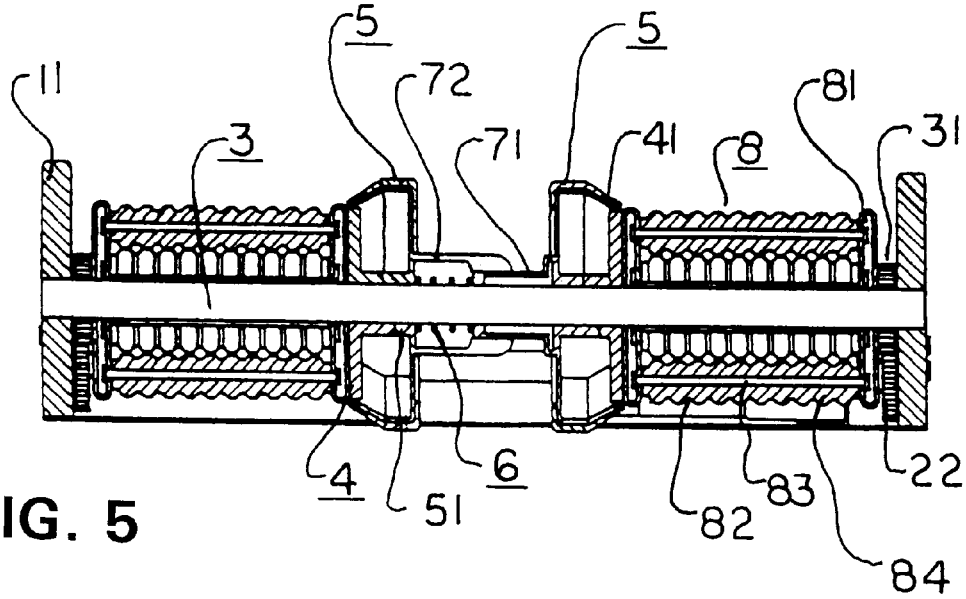
FIG. 5 is a central vertical sectional view showing the status which a pair of kneading members of the portable massage device of the present invention are separated from each other.
Figure 6:
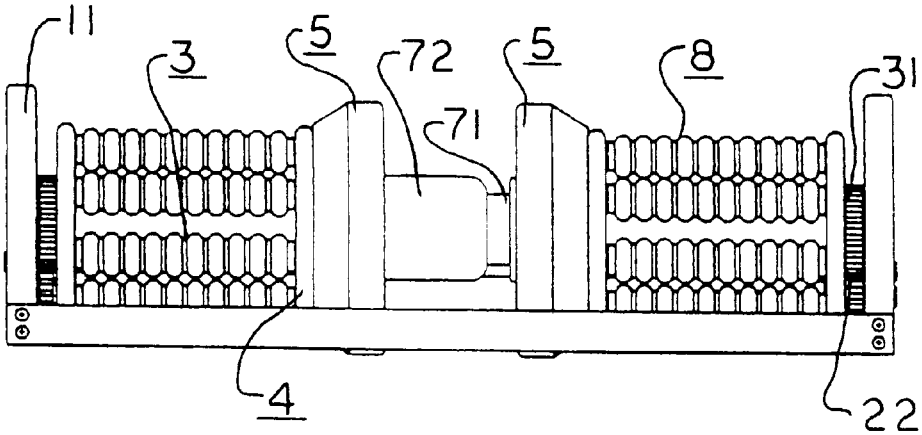
FIG. 6 is a front view showing the status which a pair of kneading members of the portable massage device of the present invention are separated from each other.
Figure 7:
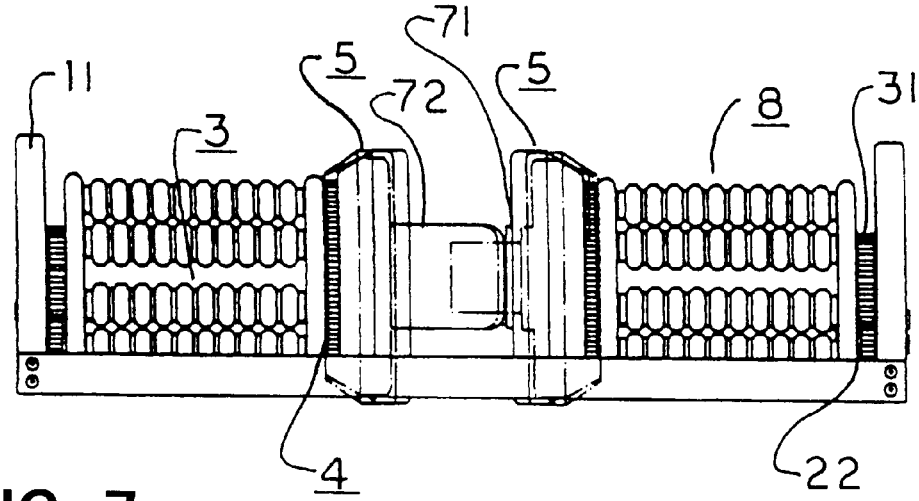
FIG. 7 is a front view showing the status which a pair of kneading members of the portable massage device of the present invention are close to each other and separated from each other.

Said spiral power spring 6, as shown in FIG. 4 and FIG. 5 for example, is made of material having spring force and is disposed between said two kneading members 5.5. When the cam parts 41 of said each driven rotary plates 4.4 rotate to make the convex part of said convex and concave surface 42 in each cam part 41 connect to the cam receiving part 51 of each kneading members 5.5, each kneading member 5.5 will be pressed, so that the two kneading members 5.5 slide toward each other as shown in FIG. 4, and then, the spiral power spring 6 will spring to the concave part of said convex and concave surface 42 of each cam part 41 to return, so that each kneading members 5.5 can be returned so as to move close to and separate from each other.

Said protection mechanism 7 for avoiding break away of the spring is disposed over the outside of said spiral power spring 6 installed between said two kneading members 5.5, and has a tube-shaped member 71 with a bottom and a tube-shaped member 72 without a bottom, for example as shown in FIG. 4 to FIG. 7. The tube-shaped member 71 with a bottom has one end fixed on one kneading member 5, the other end connects with said spiral power spring 6, and slides along to the driven rotary shaft 3. The tube-shaped member 72 without a bottom has one end is fixed on the other kneading member 5, the other end can inlay into said tube-shaped member 71 with a bottom, and slides along to the driven rotary shaft 3.

It can be avoided that a part of a user is grasped by the spiral power spring 6, and that some mechanical failure causes the spring to extend radially due to the mechanism 7 is disposed over the outside of the spiral power spring 6.

8 are driven rotary members respectively disposed between a pair of fixed plates 11.11 of said outside frame 1 and said two kneading members 5.5. The driven rotary members 8 each comprises a pair of drum-shaped tube members 81 having a center opening receiving said driven rotary shaft 3 respectively positioned between the two fixed plates 11.11 of the outside frame 1 and said two kneading members 5.5, and a plurality of rolling members 82 erected to extend radially outside of this drum-shaped tube member 81 at a regular interval. So roll a part of a user can be provided rolling massage (sliding massage) by these rolling members 82.

The rolling members 82 comprise a plurality of holding shafts 83 and rotary members 84 rotatably held on each holding shaft 83 and extending radially outwardly of members 81. When said driven rotary shaft 3 is rotated, a plurality of rotary members 84 will connect to a part of a user to provide rolling massage to the user.

Two fixed plates 11.11 of said outside frame 1 are constructed to an inverted "V" shape or an egg-shape when viewed from the side to avoid said kneading members 5 and driven rotary shaft 8 to connect with the setting surface when said kneading members 5 move close to and separate from each other or driven rotary member 8 rotates.

Figure 12:
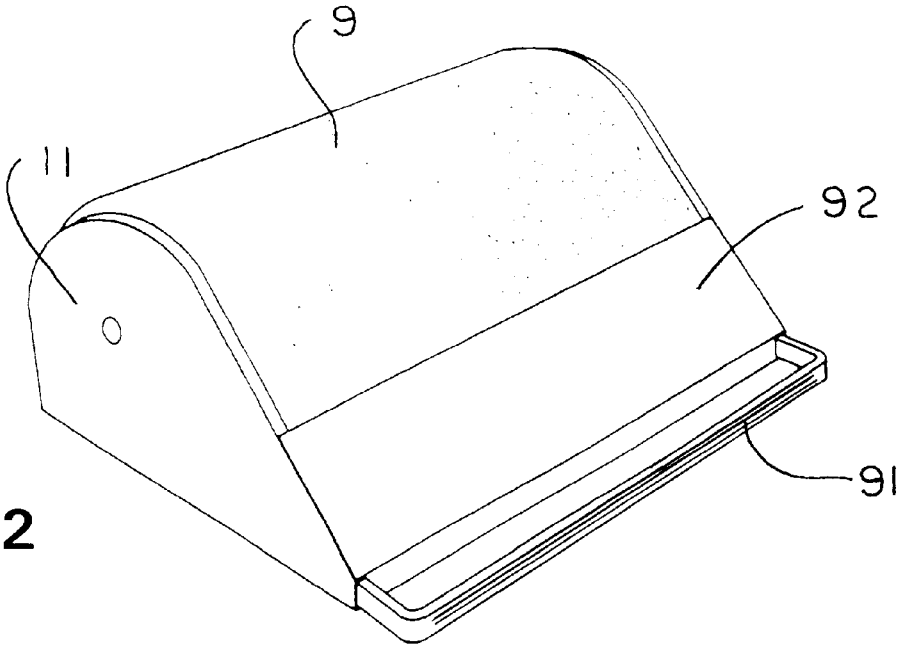
FIG. 12 is an oblique drawing showing a portable massage device which is another embodiment of this invention.

A cover 9 made in a soft material covers the outsides of said kneading members 5 and driven rotary member 8 between two fixed plates 11.11 of said outside frame 1 as shown in FIG. 11 and FIG. 12, this cover 9 can relax the connecting force (friction) to a part of a user, and can make the portable massage device become beautiful.

91 is a handle for grasping the body (frame) of massage device for portability 92 is a holding foot part for holding a foot.

A technical ability of changing speed or a remote control for controlling the speed is disposed into the portable massage device of the present invention according to object or standards of the massaging device.

As said above, the portable massage device of the present invention comprises rolling members and a pair of kneading members which move close to and separate from each other oppositely and are driven by a driving mechanism disposed on a pair of fixed plates of outside frame, and is different with prior massage device, and provides two kind of massage effects, namely rolling massage and special kneading finger pressing massage to repeat the motion of gripping like a person does and separating from each other in a twinkling motion, and has an effect for simple and low cost construction.

The portable massage device of the present invention comprises a mechanism part which is opened between a pair of fixed plates of outside frame so as to have about 180 degree range for providing kneading finger pressing massage like fingers of a person and rolling massage.

The portable massage device of the present invention comprises a protection mechanism for avoiding spring break away, disposed over the outside of said spiral power spring which returns the two sliding kneading members, and can avoid wounding a part of a user by the spiral power spring so as to increase safety.

The portable massage device of the present invention comprises a guide rod which is erected between a pair of fixed plates of said outside frame, so that two kneading members move close to and separate from each other oppositely without rotary movement along to the guide rod so as to provide kneading finger pressing massage to a part of a user without too strong a rubbing force, and has high convenience and safety.

Further, the portable massage device of the present invention comprises a convex and concave surface formed on cam part of said driven rotary plates, and can set up depth and numbers of convex and concave wilfully to change the width and speed of kneading finger pressing according to a user's wish, and can satisfy their needs.

What is claimed is:

1. A portable massage device, comprising:

a frame having fixed plates;

a driving mechanism disposed on one of said plates;

a rotary drive shaft rotatably held on said plates and rotatably driven by said driving mechanism;

rotary plates disposed on a center part of said drive shaft facing each other and driven by said driving mechanism, said rotary plates each including a rotatable cam part and a nonrotatable, freely slidable kneading member, said cam parts each including a convex and concave cam surface formed on one end thereof, said kneading members each including a cam follower, wherein said cam followers respectively contact said cam surfaces so that said kneading members move toward and away from each other along said drive shaft as said cam part rotates to effect a kneading massage of a user; and a spring cooperating with said kneading members for urging said kneading members against said cam parts so that said kneading members repeatedly move toward and away from each other to effect a kneading massage.

2. The massage device according to claim 1, wherein said driving mechanism includes a drive motor rotating a drive shaft and a driving gear fixed to said drive shaft, said rotary drive shaft includes a driven gear, said rotary plates each includes a driven plate gear, said driving gear engages said driven gear and driven plate gears to rotate said drive shaft and rotary plates.

3. The massage device according to claim 2, wherein said driving mechanism includes a rotary plate-engaging drive shaft rotatably mounted on said frame, said rotary plate-engaging drive shaft includes a first gear meshed to said driving gear and said driven gear to transmit rotary motion from said driving gear to said driven gear and said rotary plate-engaging drive shaft, and said rotary plate-engaging drive shaft includes second gears meshed to said rotary plates to transmit rotary motion from said driving gear to said rotary plates.

4. The massage device according to claim 1, wherein said kneading members includes means for protecting the user from contact against said spring.

5. The massage device according to claim 4, wherein said means for protecting include first and second protection members both axially slidable along said drive shaft, said first protection member being a tube-shape and including a spring contacting first end and a second end fixed to one said kneading member, said second protection member being a tube-shape and including an open first end through which said first end of said first protection member is received and a second end fixed to another said kneading member, and said spring being radially enclosed by said second protection member.

6. The massage device according to claim 1, wherein said frame includes at least one guide rod extending between said fixed plates, said fixed plates each including at least one guide hole opening therethrough rotatably supporting said at least one guide rod.

7. The massage device according to claim 6, wherein said kneading members each include guide holes receiving said at least one guide rod therein.

8. The massage device according to claim 1, wherein said convex and concave surfaces each is formed in stages so that a convex portion follows a concave portion thereby effecting movement of said kneading members toward and away from each other.

9. The massage device according to claim 1, wherein said convex and concave cam surfaces each include a plurality of concave and convex portions so that the cam surfaces respectively include an undulating surface.

10. The massage device according to claim 1, wherein said kneading members include first and second protection members both axially slidable along said drive shaft, said first protection member being a tube-shape and including a spring contacting first end and a second end fixed to one said kneading member, said second protection member being a tube-shape and including an open first end through which said first end of said first protection member is received and a second end fixed to another said kneading member, and said spring being radially enclosed by said second protection member.

11. A portable massage device, comprising:

a frame including fixed sides;

a drive mechanism mounted to said frame and including a rotating first shaft;

an elongate rotatable second shaft rotatably supported on said fixed sides and rotated by said first shaft, said second shaft including means for providing a rotating massage adjacent said fixed sides;

an elongate third shaft rotatably mounted to said fixed sides and rotated by said first shaft;

two kneading massage members positioned on said second shaft remote from said fixed sides and facing each other, said kneading massage members each including a rotatable cam part rotatably driven by said third shaft and a kneading part nonrotatably, axially movably mounted on said second shaft, said cam part including a cam surface, said kneading member including a cam follower contacting said cam surface so that said kneading members linearly move toward and away from each other as said cam parts rotate to effect a kneading massage; and a coil spring mounted on said second shaft between said kneading members to urge said kneading parts away from each other and said cam follower against said cam surface.

12. A portable message device, comprising:

a frame;

a driving mechanism disposed on said frame;

a rotary drive shaft rotatably supported on said frame and rotatably driven by said driving mechanism, said drive shaft being elongate along its axial direction;

rotary members disposed on said drive shaft facing each other and driven by said driving mechanism, said rotary members each including a rotatable cam part and a nonrotatable, axially slidable kneading member, said cam parts each including a cam surface formed on one end thereof, said kneading members each including a cam follower, wherein said cam surface being wave-shaped and said cam followers respectively contacting said cam surfaces so that said kneading members move toward and away from each other along the axial direction of said drive shaft as said cam part rotates to effect a kneading massage of a user; and a biasing member cooperating with said kneading members for urging said kneading members against said cam parts so that said kneading members repeatedly move toward and away from each other to effect a kneading massage.

13. The portable massage device according to claim 12, wherein said cam surfaces include concave and convex portions.

14. The portable massage device according to claim 13, wherein said cam surfaces are disposed in an opposing relationship.

15. The portable massage device according to claim 12, wherein said biasing member is disposed axially between said kneading members.

* * * * *

UNITED STATES PATENT AND TRADEMARK OFFICE
CERTIFICATE OF CORRECTION

PATENT NO : 6 056 709
DATED : May 2, 2000
INVENTOR(S) : Kouji HASHIMOTO

It is certified that error appears in the above-identified patent and that said Letters Patent are hereby corrected as shown below:

On the title page, please change

"[30] Foreign Application Priority Data
Jan. 30, 1999 [JP] Japan ..... 10-033799"

to ---[30] Foreign Application Priority Data
Jan. 30, 1998 [JP] Japan ..... 10-033799---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*